United States Patent [19]

Wu

[11] Patent Number: 4,688,835

[45] Date of Patent: Aug. 25, 1987

[54] ADJUSTABLE LATCHING APPARATUS AND METHOD OF LATCHABLY PRESSING AND HOLDING TOGETHER

[75] Inventor: Kim F. Wu, Garden Grove, Calif.

[73] Assignee: Rockwell International Corporation, El Segundo, Calif.

[21] Appl. No.: 673,709

[22] Filed: Nov. 21, 1984

[51] Int. Cl.[4] ..... E05C 5/02

[52] U.S. Cl. ..... 292/59

[58] Field of Search ..... 292/58, 59, 251, 257, 292/341.18, 57, 60, 61, 62

[56] References Cited

U.S. PATENT DOCUMENTS

| | | | |
|---|---|---|---|
| 3,950,971 | 4/1976 | Karls | 70/164 |
| 4,077,299 | 3/1978 | King, Jr. | 85/1 P |
| 4,099,758 | 7/1978 | Yamamoto et al. | 292/341.18 |
| 4,243,255 | 1/1981 | Hornak | 292/113 |
| 4,320,912 | 3/1982 | Grace et al. | 292/341.18 |

OTHER PUBLICATIONS

Soled, Julius, *Fasteners Handbook,* 1957, Section J, pp. 343–367, Reinhold Publishing Corp.

Laughner, V. H. and Hargan, A. D., *Handbook of Fastening and Joining of Metal Parts,* pp. 422, 423, and 546, McGraw Hill, 1956.

"Expandable Diameter Fasteners", catalog section 10 of Shur-Lok Corporation Catalog, 9th Edition, 1973, Irvine, Calif.

"Miniloc" brochure published by The Paneloc Corporation, 4 pages, apparent date 1077 or Oct. 1977, Farmington, Conn.

"Paneloc-High-Performance Quick Operating Fasteners", brochure published by The Paneloc Corporation, 8 pages, apparent date of publication Jul. 1980, Farmington, Conn.

"Three Dimensional Fasteners", brochure published by Adjustable Bushing Corp., 26 pages, 1983, North Hollywood, Calif.

"Expando" brochure published by Adjustable Bushing Corp., 2 pages, U.S. Pat. No. 3,378,648 noted, North Hollywood, Calif.

"Pins-EGP" brochure, apparently published by Adjustable Bushing Corp., 4 pages, North Hollywood, Calif.

"Other Specialty Fasteners" published by Camloc, 1 page.

*Primary Examiner*—Richard E. Moore

*Attorney, Agent, or Firm*—H. Fredrick Hamann; George A. Montanye; Jonathan B. Orlick

[57] ABSTRACT

A latching apparatus and method for adjustably pressing and holding together two members, in either an abutting or controlled gap relationship with respect to each member. The apparatus comprises a handle and opposite end which is cam shaped. A shaft is pivotally attached to the cam shaped end of the handle and is supported in a mounting hole of the first member. The end of the shaft is fitted with a cross member for rotatably interlocking a male counterpart with an internally slotted female counterpart sleeve. This sleeve is adjustably fixed to the desired depth within the second member and is positioned coaxially within the mounting hole therein for conditionally receiving the shaft's cross member. Captive interlock of the shaft by the sleeve is achieved by the sliding and rotating operation of the cam shaped end of the handle which has an axis of rotation perpendicular to the longitudinal axis of the handle. This lever action also causes the cam surface to compressively hold the first and second members together in an abutting or controlled gap relationship. This relationship being determined by the sleeves adjustable seating depth within the second member in conjunction with the shaft's adjustable attachment to the cam shaped handle assembly.

29 Claims, 16 Drawing Figures

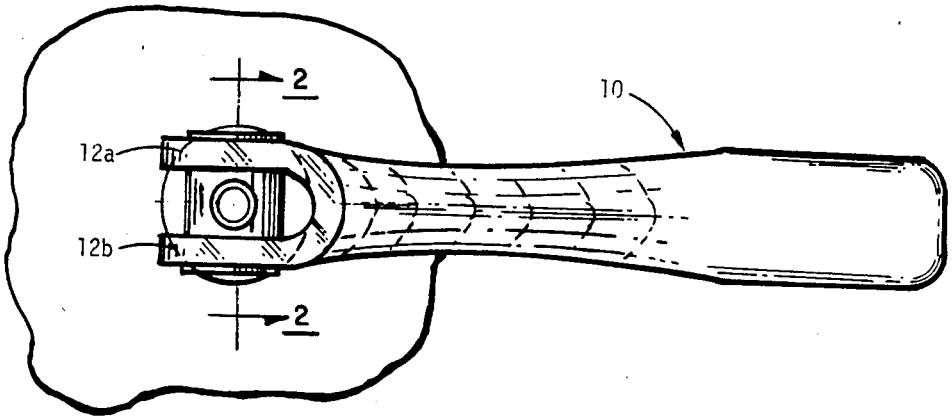
FIG. 1a UNLOCKED & RELAXED CONDITION
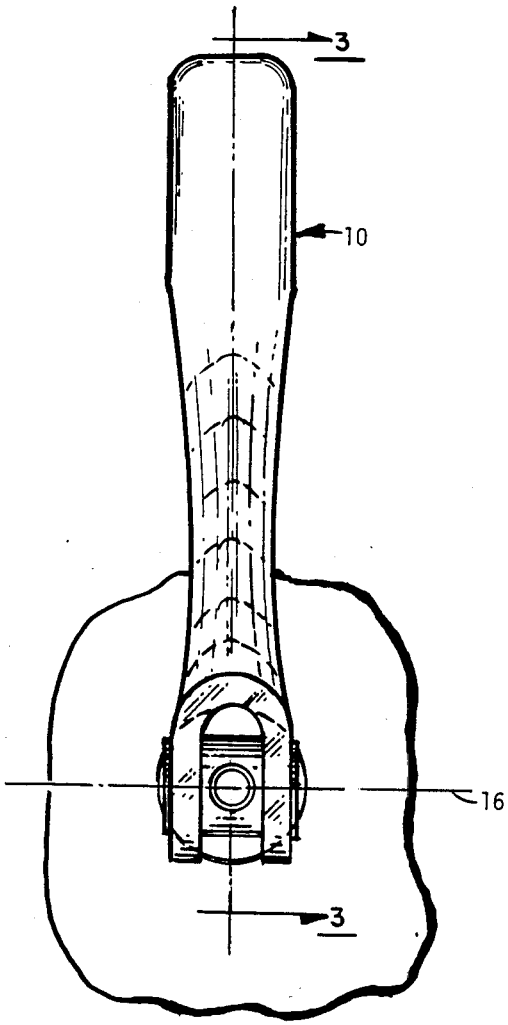
FIG. 1b LOCKED & RELAXED CONDITION
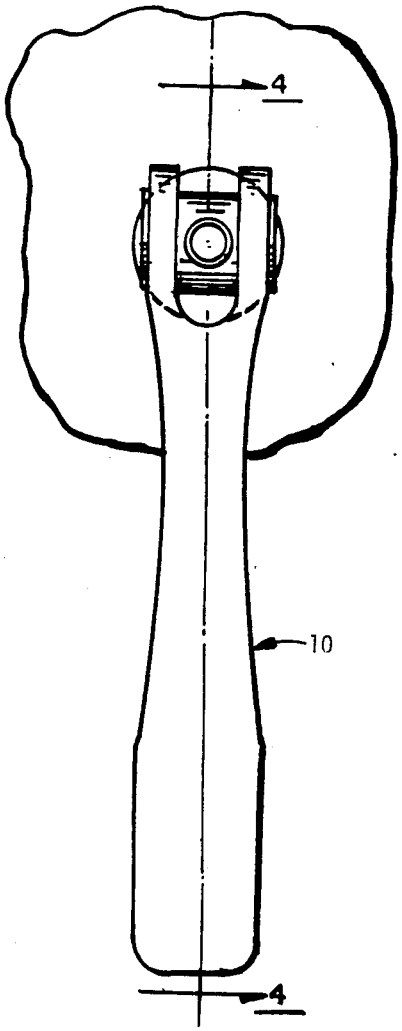
FIG. 1c LOCKED & TAUT CONDITION

ADJUSTABLE LATCHING APPARATUS AND METHOD OF LATCHABLY PRESSING AND HOLDING TOGETHER

BACKGROUND OF THE INVENTION

This invention relates generally to latching apparatuses for pressing and holding together first and second members and more particularly to adjustable positive latching apparatuses for and a method of latchably pressing and holding together first and second members.

In a military combat environment, there is often the need for easily releasable latches to allow for the quick separation of structural members such as the unlatching of a cabinet door. Additionally, the need exists for positive latching apparatuses which are capable of maintaining the secure and reliable closure of such members. Also, the alignment of one member to the other is often necessary to the proper closure of interfacing members. To further extend the applicability of such latching apparatuses, it is advantageous to have such devices be adjustable in the manner in which they are installed and the degree of compression to which the members are subjected at their common interface. Existing devices, though capable of providing some of these characteristics, typically cannot provide all of these features. Also, for certain naval shipboard applications requiring equipment to be mounted in cabinet type enclosures having latched doors, positive and quick release latching apparatuses are needed to further provide some measure of alignment of one closure member to another to accommodate various types of sealing gaskets. Additionally, in a combat environment or in emergency situations, an easily operable latching device is highly desirable which has a low profile to avoid clothing or other snags while in a locked condition which could unlock the latching device.

SUMMARY OF THE INVENTION

It is the therefore the object of this invention to provide a positive latching apparatus which is adjustable in its application to the desired degree of compression under closure and to provide a method for latchably compressing and holding together first and second members. It is a further object of this invention to provide a latching apparatus which is easily operable and capable of quick release and desirably aligns the members to be brought and held together in compression. It is a further object of this invention to provide a latching apparatus whose member parts are inexpensive to manufacture, is easily assemblable, and is adjustable to accommodate a variety of latching requirements.

These objects and others, which will become apparent in the description to follow, are achieved in the present invention of a latching apparatus for adjustably pressing and holding together first and second members where the latching apparatus has a first part comprising a handle attached to a shaft which is mounted on the first member coaxially with a mounting hole through that member, and a second part for receiving and captively interlocking with the leading or distal end of the shaft which is mounted on the second member and which is coaxial with a mounting hole through that member. In a latched condition, it is desired to have the hole in the first and second members coaxially aligned.

Latching is carried out by a shaft portion of the first part mounted on the first member being inserted into the second part mounted on the second member, followed by a rotation of the shaft, typically a quarter turn, to interlock the first part with the second part, and then pivoting the handle through approximately 180 degrees about a cam surface integral with the attached end of the handle to effectively shorten the working length of the shaft portion of the first part inserted and captively interlocked to the second part, thereby causing a compression of the first and second members at their common interface.

Such an apparatus comprises a handle having an end for grasping and an opposite end in the shape of a cam surface, where the cam surface has a cam axis rotation perpendicular to the longitudinal axis of the handle, a shaft supported in the mounting hole of the first member having proximal and distal ends and comprising means in the proximity of the distal end for rotatably interlocking as a male counterpart, where the proximal and distal ends project beyond the front and back surfaces of the first member, respectively. The apparatus also comprises means pivotally attaching the opposite end of the handle to the proximal end of the shaft, and receptacle means adjustably affixed to the second member and coaxial with the mounting hole in that member for conditionally receiving the means for rotatably interlocking to an adjustable seating depth and for interlocking as a female counterpart with the means for rotatably interlocking by a partial turn of the shaft at seating depth. The seating and partial turn are taken with the handle in a correspondingly relaxed condition to effect the captive interlock of the male and female counterparts for rotatably interlocking. This subsequently enables the first and second members to be compressed and held together by lever action of the handle cam surface slideably rotating and pushing increasingly harder against the area of the front surface surrounding the mounting hole as the handle is pivoted about its cam axis from a relaxed to a taut condition.

In one embodiment, the means for rotatably interlocking as a male counterpart comprises a cross member affixed to the shaft near the distal end of the shaft protruding outwardly of and substantially perpendicular to axis of the shaft. This cross member in certain cases is a press-fit pin which is inserted into a transverse hole near the distal end of the shaft. In such an embodiment the receptacle means complements the cross member in the sense that it comprises a sleeve which is adjustably retained in the mounting hole of the second member where the sleeve has a central bore with diametrically opposed key slots of dimensions to match the cross member such as to freely pass the cross member on the shaft to an engaging depth on condition the cross member is aligned to the bore key slot corresponding to the handle being in an unlocked and relaxed condition. Once the distal end of the shaft has been inserted to a seating depth, rotation of the shaft by a predetermined amount and direction about the shaft axis effects the captive interlock of the cross member with the sleeve such the shaft cannot be withdrawn because the cross member is so engaged with the sleeve that withdrawal is not possible. At this point, if the working length of the shaft is effectively shortened by the action of the handle cam surface pushing against the front surface of the front member, the cam action or lever action of the cam surface against the front surface of the first member causes the first and second members to be compressed and held together as the handle is rotated about the cam axis approximately 180 degrees because the shaft is now anchored at its distal end by the captive interlock of the cross member to the sleeve.

The sleeve is held adjustably fixed in several ways relative to the mounting hole in the second member. A first way is to provide matched threads to the hole and the external surfaces of the slotted sleeve such that the slotted sleeve is internally screwed into the hole and retained at the desired position by a set screw. Another way is to have a holder with a threaded central hole in which the sleeve is fixedly mounted and where the holder itself is mounted in fixed relationship to the second member coaxially with the mounting hole in that second member.

Various arrangements are possible for the shaft design. A simple design is a rod threaded at the proximal end having a transverse hole at the distal end for accepting and holding a press-fit pin to serve as the cross member which interlocks with the key-slotted sleeve type receptacle means. The threaded portion at the proximal end is used to attach the handle to a knuckle pin which in combination with a handle bifurcated at the attached end, pivotally attaches the handle to the shaft. This type of handle has two planar parts at the bifurcated end which are substantially parallel to each other. Both of these parts have aligned holes through them which define an axis of rotation for the cam surface. The cylindrical knuckle pin is placed in the holes and the threaded end of the shaft is attached to the cylindrical knuckle pin which has a threaded hole perpendicular to the axis of the pin. The shaft is held in position relative to the knuckle pin by a set screw along the axis of the pin which screw impinges upon a planar surface unified with the threaded portion.

One means of retaining the shaft with handle attached in the mounting hole in the first member is by the use of a frustum-shaped helical coil mounted on the shaft which has a wide end pushing against the back surface of the first member and a narrow end pushing against a washer resting against either a shoulder or a pin in the shaft, the shoulder version of the shaft being a shaped shaft where an abrupt interface between a thinner portion and a thicker portion serves as a shoulder to keep the washer and consequently the narrow end of the spring from sliding down the thicker portion of the shaft. The thicker portion of the shaft also serves to centrally align the shaft to the mounting hole in the second member. Because the shaft is attached to the first member, insertion of the thick portion of the shaft in the mounting hole in the second member brings the first and second members into some degree of lateral alignment. How close an alignment can be achieved depends on the tolerances of shaft fit and the tolerance to lateral motion where the shaft is attached to the first member. In either the rod or the shaped shaft configurations, the distal end of the shaft has a cross member which is typically a press-fit pin inserted into a hole perpendicular to the shaft axis.

In certain applications, it is necessary to provide a controlled gap between the first and second members under closure. Frequently, to meet electromagnetic interference requirements, it is necessary to seal all openings in an electronic enclosure with a special gasket which provides conductive continuity between the cabinet and the door closing on such cabinet openings. In these applications, it can be critical to provide a controlled gap between the inner surface of the door and doorjamb structure, such that the gasket does not get pinched or overly compressed and damaged. Other applications, such as water or air-tight enclosures requiring compressible elastic gaskets around openings are also instances where a controlled gap is required between the door and the jamb structure. To facilitate such a controlled gap, some embodiments of the present invention call for a spacer to be mounted on the surface of the jamb structure facing the door member.

To provide for the controlled compression of such a gasket in some cases requires very fine control over the compression of the first member against the second member, i.e., the door to the door jamb. To accommodate such fine adjustment, the present invention in certain of its embodiments utilizes the concept of differential threading, whereby screw adjustments of various parts of the apparatus at opposite ends of the shaft, which determine the degree of compression, have slightly different pitches, such that with a half or full rotation of thread-mated elements concurrently at both ends of the shaft provides for very fine adjustment of the effective working length of the shaft and of the consequent degree of member to member compression.

In addition to providing a space for gaskets such as is described above, the controlled gap between the first and second members so provided can also be utilized to provide space for the frustum-shaped helical coil spring and washer and, in certain embodiments, a cylindrical pin mounted transversely to the shaft, which together retain the shaft in the mounting hole of the door.

Another means for providing the space for the coil spring, washer, and pin combination when the first and second members are brought together without use of a spacer mounted on the front surface of the second member is by counterboring the second member about the mounting hole or by counterboring about the mounting hole in the first member on its back surface where thickness of that member allows. The present invention contemplates the former means of providing space for the means for retaining the shaft in the mounting hole of the first member.

In addition to the previously described means for captively interlocking the shaft member with a receptacle means, other configurations which are the converse conceptually to those previously described are also disclosed in the present invention. For example, in one configuration, the receptacle means comprises a keyplate having a keyhole in the plate which is fixedly mounted on the doorjamb member having at least one keyway tab extending radially inward from the edge of the keyhole, the keyhole being coaxially aligned to the mounting hole in the second (doorjamb) member. The keyhole and tab are of dimensions conditionally allowing free penetration to an engaging depth of a collar mounted on the shaft towards the distal end in which the collar has a key slot. Upon condition the key slot is rotationally aligned to the keyplate tab, unimpeded free penetration of the distal end of the shaft to an engaging depth is permitted. Upon seating at the engaging depth, rotation of the shaft a predetermined direction and amount, misaligns the slot and the tab thereby preventing the subsequent withdrawal of the collared shaft.

In another configuration, the receptacle means comprises an externally threaded cylindrical sleeve mounted in a threaded counterbore on the back side of the second member. The sleeve has a central coaxial hole to receive the distal end of the shaft. The sleeve also has a cross member that is mounted transversely and diametrically across the central coaxial hole in a fixed position. The shaft is a hollow cylindrical rod which fits through the central coaxial hole of the sleeve. The cylindrical rod has a pair of diametrically opposing longitudinal slots at the distal or leading end of the shaft where the dimensions of those slots are large enough to receive the sleeve mounted cross member to a seating depth. The longitudinal slots terminate in partially circumferential slots, the circumferential slots having a detent towards the distal end. When the shaft is inserted into the receptacle means, i.e., the cylindrical sleeve with diametrically mounted cross member, it meshes the cross member in the slots as the shaft is inserted. After the shaft has reached an engaging depth corresponding to the end of the longitudinal slots, the shaft can no longer be further inserted. However, with a partial rotation of the shaft about its axis, the cross member then is captively interlocked into the circumferential slots in the cylindrical shaft. The detent in the circumferential slots provides a means for retaining the shaft in a position in which it will not easily derotate and release.

An additional part of the present invention involves the use of latching apparatus of the present invention in a method for latchably pressing and holding together first and second members.

BRIEF DESCRIPTION OF THE DRAWINGS

These and other objects, features, and advantages of the invention as well as the invention itself, will become more apparent to those skilled in the art in the light of the following detailed description taken into consideration with the accompanying drawings wherein like reference numerals indicate like or corresponding parts to the several views and wherein:

FIGS. 1*a*, 1*b*, 1*c*, show the three primary positions of the latch handle of the present invention.

DESCRIPTION OF THE PREFERRED EMBODIMENT

Figure 7:
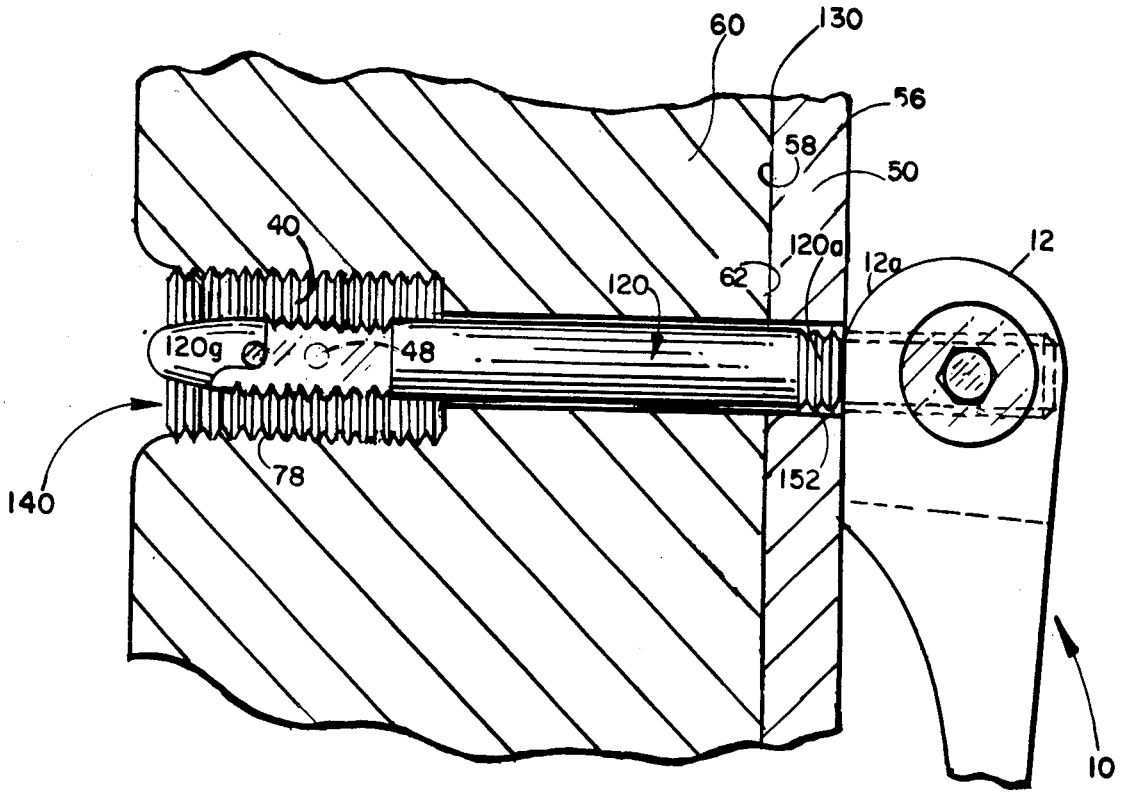
FIG. 7 is a cross section shown partially in elevation of a second embodiment of the present invention with handle in a locked and taut condition similar to the view of the first embodiment shown in FIG. 4.
Figure 8:
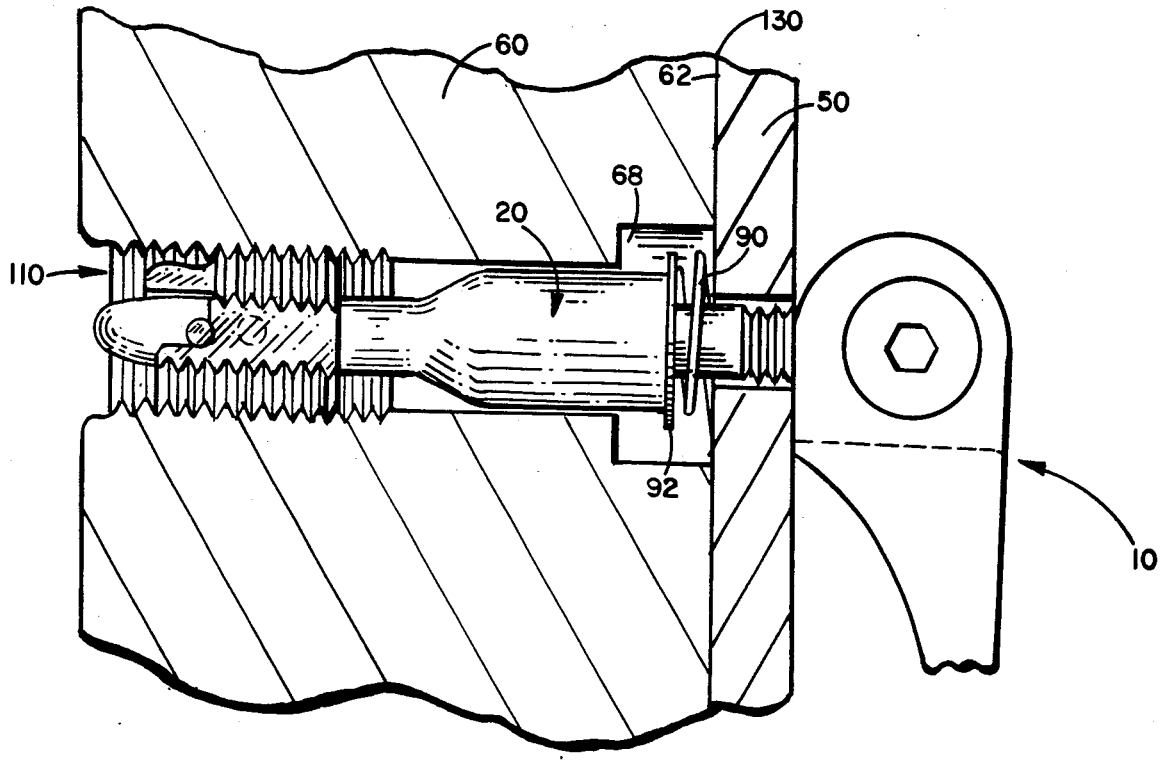
FIG. 8 is a cross section shown partially in elevation of a third embodiment of the present invention with handle in a locked and taut condition.
Figure 9:
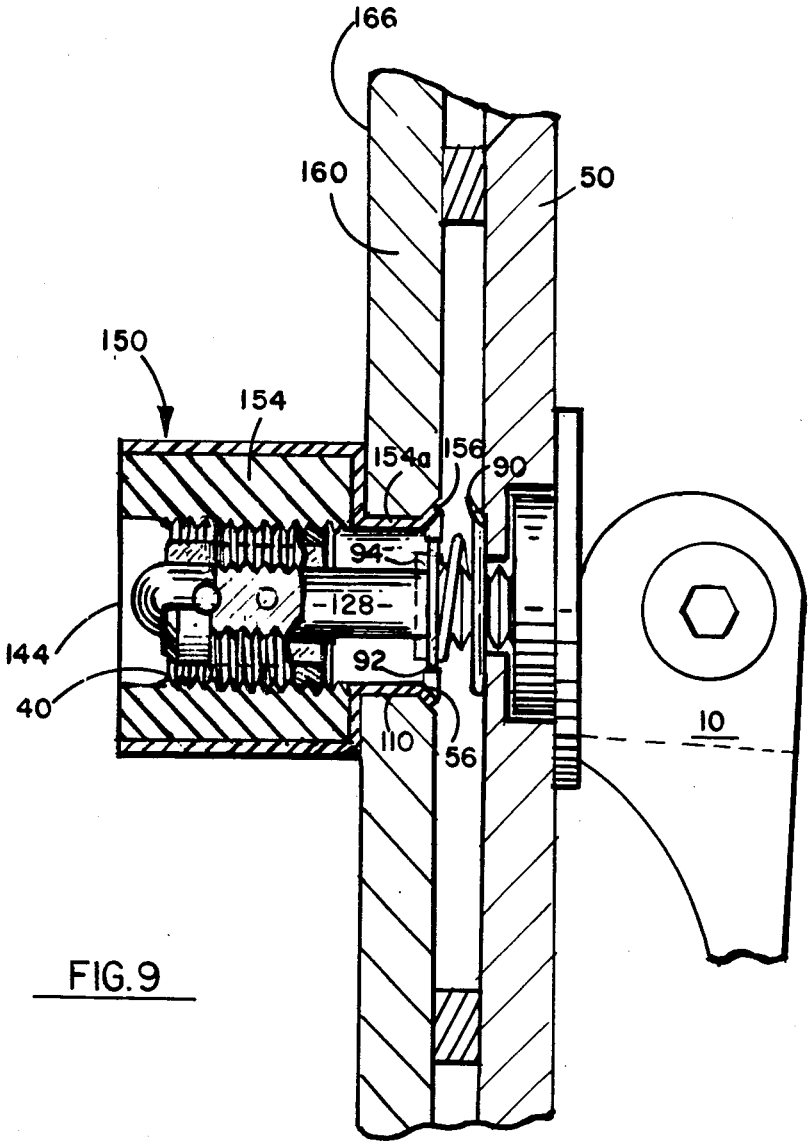
FIG. 9 is a cross section shown partially in elevation of a fourth embodiment of the present invention with handle in a locked and taut condition.
Figure 10:
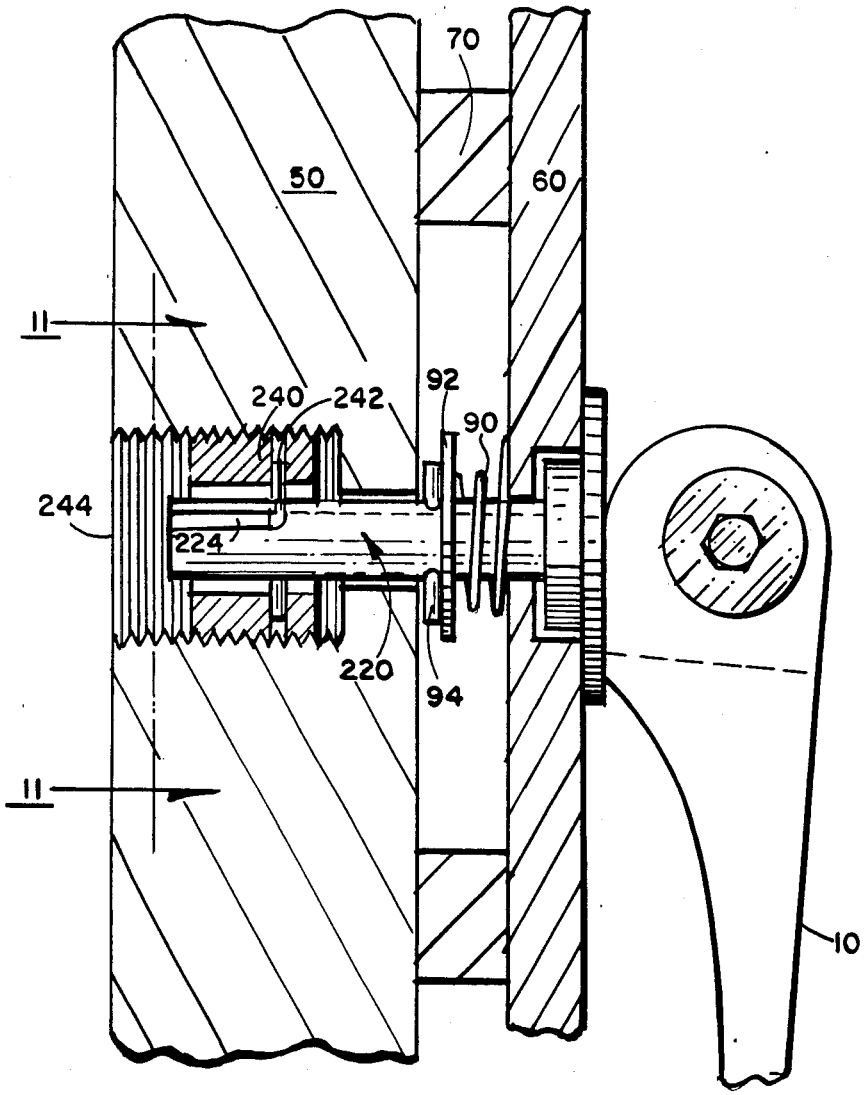
FIG. 10 is a cross section shown partially in elevation of a fifth embodiment of the present invention with handle in a locked and taut condition.
Figure 11:
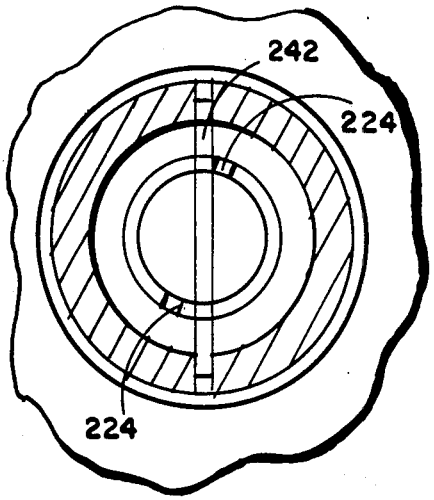
FIG. 11 is a cross section shown partially in elevation of the fifth embodiment of the present invention with handle in a locked and taut condition taken along lines 11—11 of FIG. 10.
Figure 12:
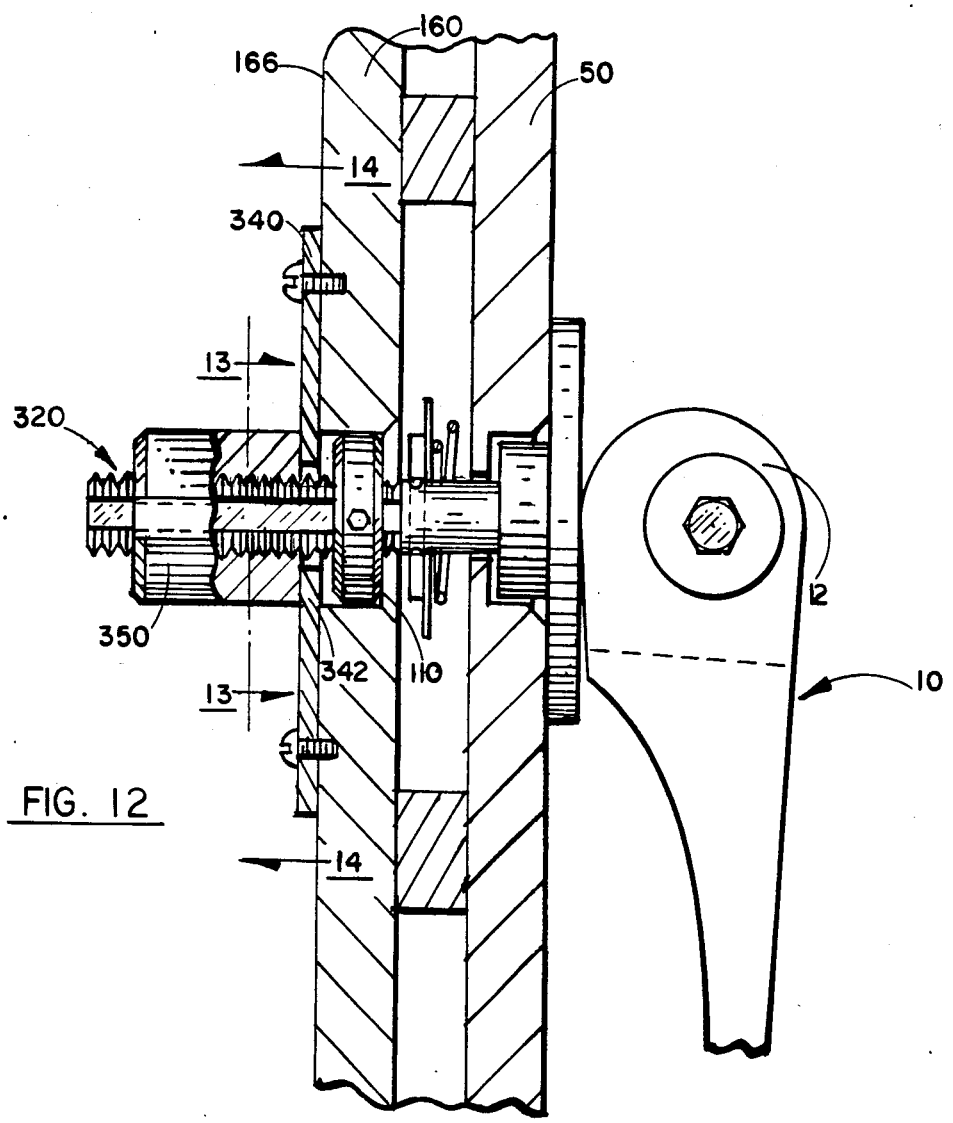
FIG. 12 is a cross section shown partially in elevation of a sixth embodiment of the present invention with handle in a locked and taut condition.
Figure 13:
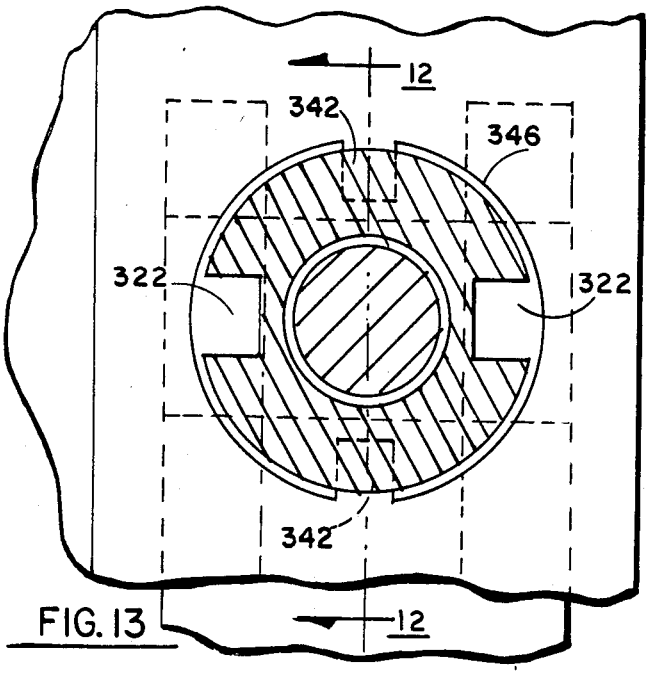
FIG. 13 is a cross section of the sixth embodiment of the present invention with handle in a locked and taut condition taken along lines 13—13 of FIG. 12.
Figure 14:
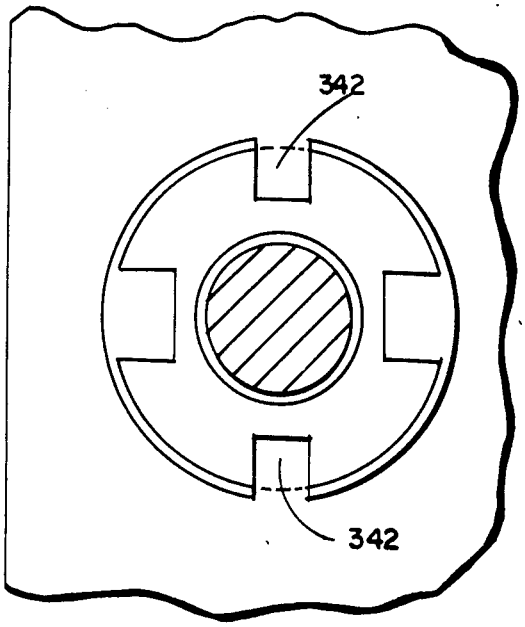
FIG. 14 is a cross section of the sixth embodiment of the present invention with handle in a locked and taut condition taken along lines 14—14 of FIG. 12.

FIGS. 1 through 6 relate to a first preferred embodiment of the present invention. A second embodiment, shown in FIG. 7, is a somewhat simplified version of the first preferred embodiment of FIGS. 1 through 6. FIG. 8 is also a slightly different version of the first preferred embodiment of FIGS. 1 through 6 with the difference primarily centered on the absence of a controlled gap between first and second members 50, 60 and the existence of a counterbore 68 about the mounting hole 110 of the second member. FIG. 9 is a fourth embodiment where the second member 160 is relatively thin such that the mounting of the receptacle means 154 within the second member is impractical. The shaft configuration is similar to that shown in the second embodiment of FIG. 8. FIGS. 10 and 11 relate to a reverse embodiment of the basic concept where the cross member 242 is held fixed in the receptacle means 240 and engages a slotted shaft 220 to a desired seating depth. FIGS. 12, 13 and 14 relate to a sixth embodiment of the present invention and indicates essentially the basic concept wherein the latching apparatus is inserted at a seating depth and then is interlocked and then latched members 50, 160 are compressed by the cam action of the handle 10 as in the first five embodiments.

A common feature of each of these six embodiments of the present invention are the interlocking steps as well as the compression which takes place as a result of the cam action of one end of the handle against the outer surface, or against a thrust washer in some of the embodiments, to bring the first and second members into a compressed gapped or ungapped relationship. These steps include shaft insertion in an unlocked condition corresponding to the orientation of the handle 10, for example, in a horizontal position as indicated in FIG. 1*a*. This then is followed by the rotational interlocking action of the shaft at the seating depth and results in the handle 10 position being rotated to the vertical up position as shown in FIG. 1*b*. The shaft, now captively interlocked at its distal end by the receptacle means, allows compression of the first and second members by the cam action of the cam surface at one end of the handle as that handle 10 is brought from a vertically up position to a vertically down position as shown in FIG. 1*c*. Each of these embodiments is designed to operate in the sequence of steps as described above. In summary, this sequence is as follows: an aligned insertion, a partial turn of the handle to captively interlock male and female counterparts at the distal end of the shaft, and followed by a pivoting of the handle about the cam-shaped end of the handle causing the working length of the shaft to be effectively shortened, thereby compressing and holding together the first and second members in either a gapped or ungapped relationship.

First Preferred Embodiment

Figure 2:
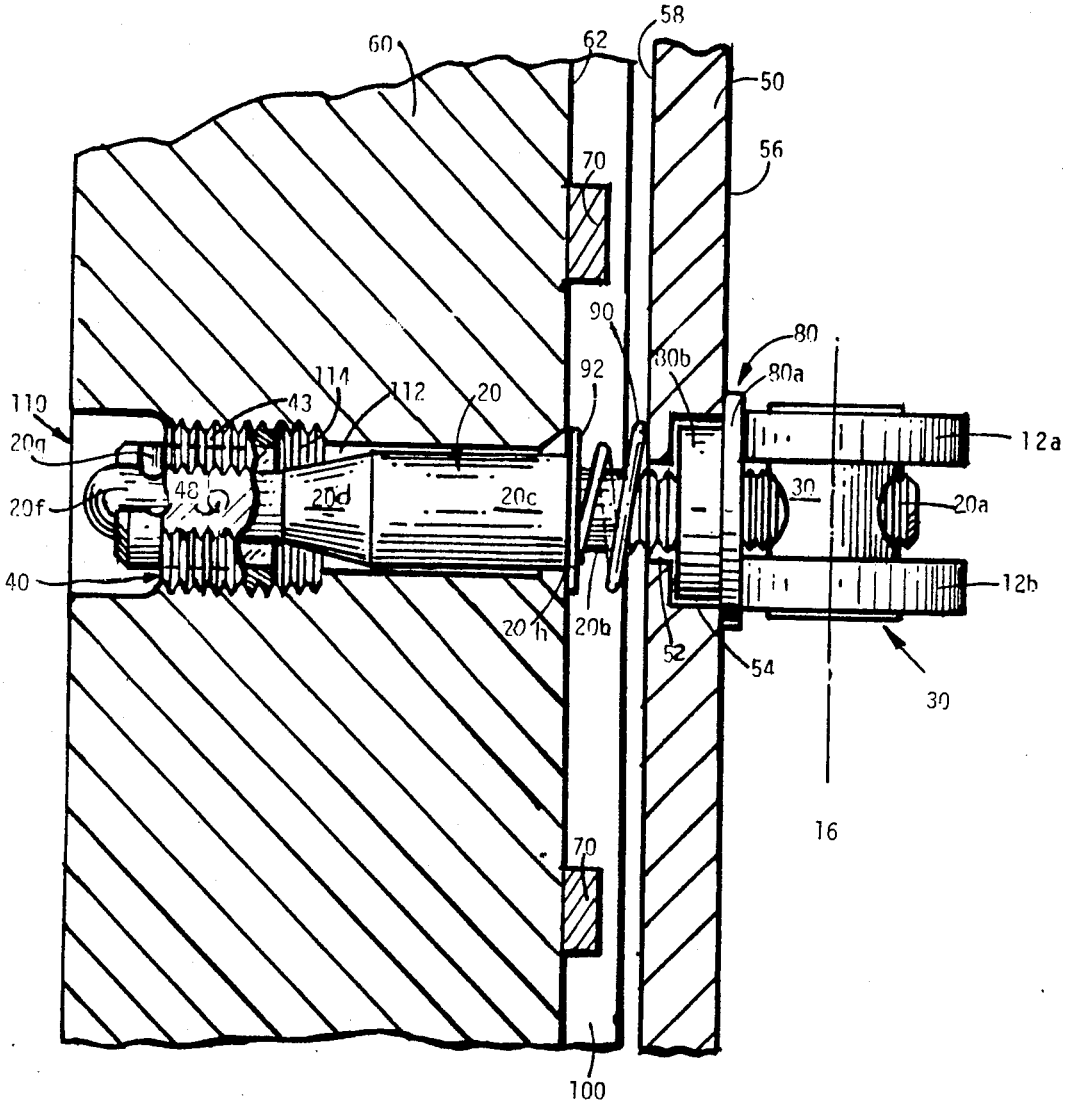
FIG. 2 is a cross section shown partially in elevation of a first embodiment of the present invention with handle in an unlocked and relaxed condition taken along line 2—2 of FIG. 1*a*.
Figure 3:
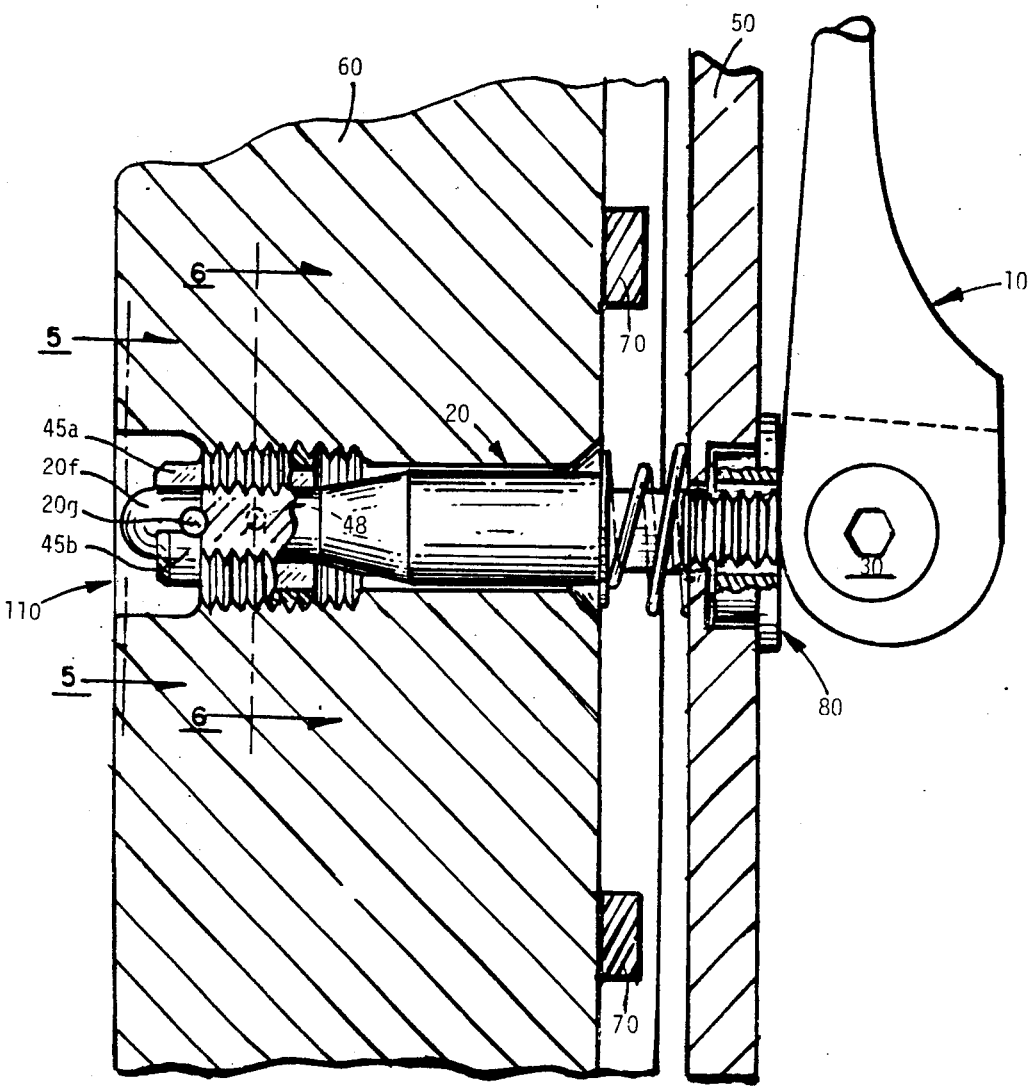
FIG. 3 is a cross section shown partially in elevation of the first embodiment of the present invention with handle in a locked and relaxed condition taken along line 3—3 of FIG. 1*b*.
Figure 4:
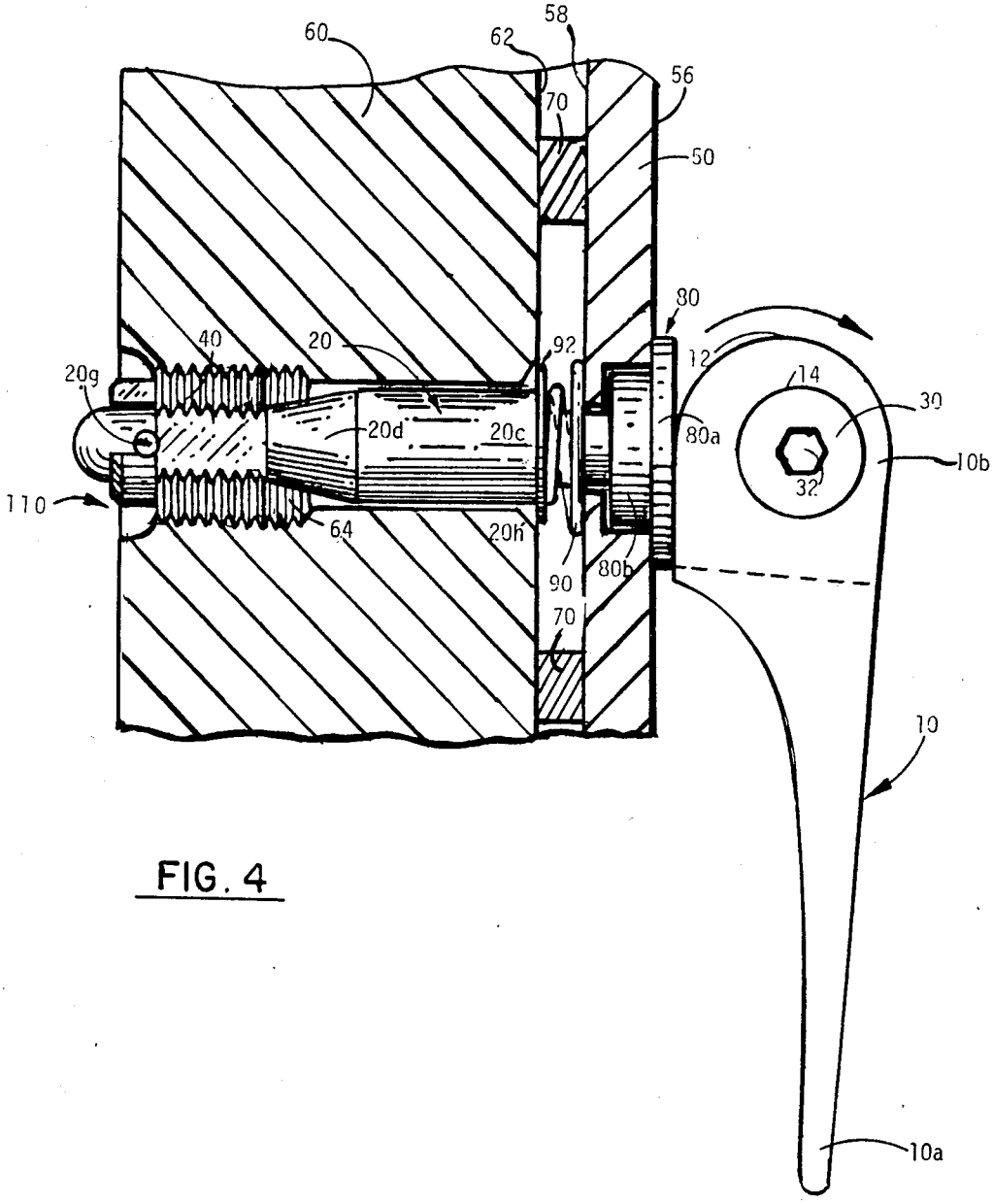
FIG. 4 is a cross section shown partially in elevation of the first embodiment of the present invention with handle in a locked and taut condition taken along lines 4—4 of FIG. 1*c*.

In FIG. 1*a*, the latch handle 10 is shown in a typically unlocked and relaxed condition. In FIG. 1*b*, the handle 10 is shown a locked and relaxed condition. In FIG. 1*c* the handle 10 is shown in a locked and taut condition. FIGS. 2, 3, and 4 correspond to the sectional views corresponding to these three positions for the first preferred embodiment of the present invention.

Referring to FIG. 4, there is seen in cross section and partially in elevation the latch apparatus of the present invention in a locked and taut condition. Structural members 50 and 60 are held together by the latch apparatus of the present invention. A spacer 70 is shown mounted to the front surface 62 of the second member 60 to provide for a controlled gap between the first and second members 50 and 60. The handle 10 is shown pivotally attached to the shaped shaft 20 through use of the cylindrical knuckle pin 30 and held fixed in that position by set screw 32. Also shown is the receptacle means 40, a sleeve with a central slotted through hole, with which the shaft 20 is engaged. In the proximity of the end of the shaft opposite the end to which the handle is attached, hereafter referred to as the distal end, there is shown a cylindrical pin **20*g* which protrudes outwardly from the shaft 20** and is substantially perpendicular to the axis of the shaft.

The handle 10 has an end for grasping **10*a* and an opposite end 10*b* in the shape of a cam surface 12 where the cam surface has a cam axis of rotation (identified as 16** in FIG. 1*b*) perpendicular to the longitudinal axis of the handle. In FIG. 1*a*, it can be seen that the handle 10 is bifurcated into a pair of facing planar parts **12*a*, 12*b* substantially parallel to each other. This pair of facing planar parts 12*a*, 12*b* have holes 14 which are coaxially aligned to each other to define the cam axis, line 16** in FIG. 1*b*.

In FIG. 2, it can be seen that shaft 20 has a threaded portion **20*a* at that end of the shaft to which the handle 10 is attached, which end is also referred to herein as the proximal end of the shaft. The handle 10 is shown attached to the shaft 20 by means of the knuckle pin 30 which is inserted in the coaxial holes (14 in FIG. 4) in the planar parts 12*a*, 12*b*. The proximal threaded end 20*a* of the shaft 20 is shown threaded into the knuckle pin 30 straddled by the planar parts 12*a*, 12*b*. This type of attachment of the handle 10 to the shaft 20 using the cylindrical knuckle pin 30 allows the pivoting of the handle 10 about the knuckle pin 30** starting from the locked and relaxed position shown in FIGS. 1*b* and 3 and ending up with the handle in the locked and taut position as shown in FIGS. 1*c* and 4. This type of attachment is also referred to elsewhere herein as means pivotally attaching the opposite end **10*a* of the handle 10 to the proximal end 20*a* of the shaft 20. Set screw 32 is used to fix the rotational position of the shaft 20 relative to the knuckle pin 30, where a flat or planar surface (not shown) is unified with the threaded portion 20*a* such as to receive the point of the set screw 32**.

In FIG. 2, the hole 52 in the first member 50 has a counterbore 54 adjacent to the front surface 56 of the first member 50. Positioned in the counterbore 54 is a thrust washer 80 having a washer portion **80*a* adjoining a neck portion 80*b* where the washer portion is interposed between the handle cam surfaces 12*a*, 12*b* and the front surface 56 of the first member beyond the counterbore and the neck portion 80*b* fitting freely within the counterbore. Where the first member 50 is a hinged door, the annular space between counterbore 54 and neck 80*b* allows for free lateral movement of the shaft 20 to facilitate insertion of the distal end of the shaft into mounting hole 110 in the second member 60. The washer 80 is used to accept and dispersively transfer to the front surface 56 of the first member 50 beyond the counterbore 54, the force of the handle cam surfaces 12*a*, 12*b* slideably rotating and pushing against the washer portion 80*a*. Pushing against the back surface 58 of the first member 50 is a frustum-shaped helical coil spring 90 having a wide and narrow end. In FIG. 4, the spring 90 is mounted about the shaft 20 at the neck portion 20*b* of the shaft, under compression between the back surface 58 of the first member 50 and a plain washer 92 abutting the circumferential shoulder 20*h* of the shaft where the wide end of the coil abuts the back surface of the first member and the narrow end of the coil abuts the plain washer. The combination of the coil spring 90 and the spring washer 92 provides a means for flexibly retaining the shaft 20 in the mounting hole 52 to maintain the handle cam surface 12 in frictional contact with the front surface 56 of the first member 50 via the intermediary of the washer portion 80*a* of the thrust washer 80. The spacer 70 provides a controlled gap between the back surface 58 of the first member 50 and the front surface 62 of the second member 60. A compressible gasket 100 is shown in FIG. 2 in a relaxed or uncompressed condition. Under compression, this gasket is compressed to the dimensions of the spacer 70. Also, because of the presence of the controlled gap, spring 90 and washer 92 do not interfere with the function of the latching apparatus holding the two members 50 and 60** together in a controlled gap relationship.

Figure 5:
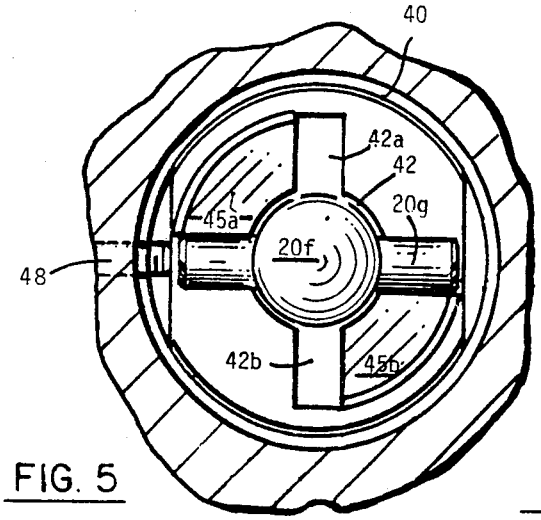
FIG. 5 is a cross section shown partially in elevation of the first embodiment of the present invention with handle in a locked and relaxed condition taken along lines 5—5 of FIG. 3.
Figure 6:
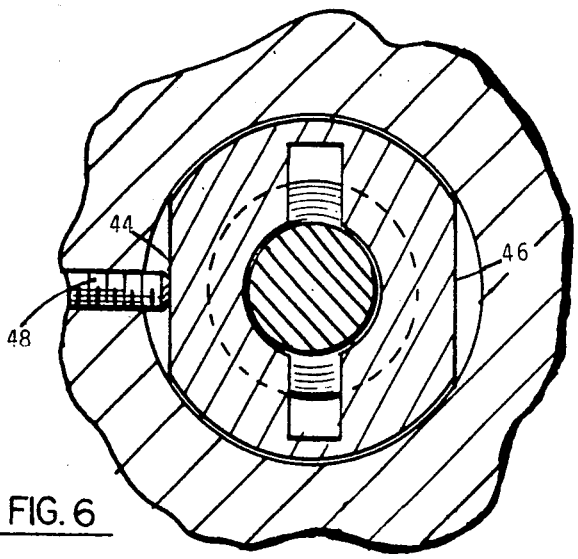
FIG. 6 is a cross section shown partially in elevation of the first embodiment the present invention with handle in a locked and relaxed condition taken along lines 6—6 of FIG. 3.

In FIG. 5 the cross member **20*g* attached to the distal end 20*f* of the shaft is a cylindrical pin which has been inserted in a transverse hole through the distal end of the shaft 20*f*. Pin 20*g* serves as a means for rotatably interlocking as a male counterpart with the sleeve 40 which is adjustably retained in the threaded portion 64 of mounting hole 110 in the second member 60 as a female counterpart. The sleeve 40 has a central bore 42 which is shown in FIG. 5. Central bore 42 has diametrically opposing key slots 42*a*, 42*b* of dimensions to allow free passage of the pin 20*g* affixed to the shaft to an engaging depth (see FIG. 3) on condition pin 20*g* is aligned to the bore key slot. This alignment of pin 20*g* with the key slots 42*a*, 42*b* corresponds to the handle 10** being in a horizontal position as shown in FIG. 1*a* corresponding to the unlocked and relaxed condition. By now rotating the handle 10 from its horizontal position of FIG. 1*a* to the vertically up position of FIG. 1*b*, pin **20*g* is captively interlocked with the sleeve 40 where the pin and slot relationship is shown in FIG. 5 corresponding to the locked and relaxed condition. Pin 20*g* and therefore the shaft 20 are prevented from rotating beyond the handle's vertically up position by stop posts 45*a*, 45*b*. This captive interlock of pin 20*g* thereby enables the first and second members 50 and 60, respectively, to now be compressed and held together in a gapped relationship by cam action of the handle cam surface 12 slideably rotating and pushing increasingly harder against the washer portion 80*a* of the thrust washer 80 and consequently the front surface 56 of the first member surrounding the counterbored mounting hole 52 of the first member as the handle 10 is pivoted substantially a half-turn about the cam axis 16 thereby pulling on the shaft anchored at its distal end by pin 20g captively interlocked with sleeve 40. Sleeve 40 is affixed to the second member by screw threads 43 matched to threads 114 in the mounting hole 110 in the second member 60. To keep the sleeve 40, identified elsewhere herein as receptacle means for conditionally receiving the cross member to an adjustable seating depth, from rotating out of position, a set screw 48 is used to hold the sleeve in a selected position. The exterior threaded surface 43 of the sleeve 40 is unified with planar surfaces 44 and 46 which allow the sleeve to be locked in position by the point of the set screw 48. This fixes the sleeve 40 in the mounting hole 110 for a particular setting. It allows for adjustment of the position of the sleeve 40 in the hole 110 by loosening the set screw 48** and rotating the sleeve to the desired depth and then retightening the set screw.

FIG. 2 shows a view of the shaft 20 indicating its general shape. Starting at the proximal (handle) end of the shaft there is a threaded portion 20a with threads which are matched to the threads of the cylindrical knuckle pin 30. Adjacent to the threaded portion 20a is a neck portion 20b having approximately the same diameter as the threaded portion. Adjacent to the neck portion 20b is the body portion 20chaving a somewhat larger cross sectional diameter than portion 20b yet small enough to fit within the mounting hole 112 in a reasonably snug relationship. Adjacent to the body portion 20c is a taper portion 20d starting at a diameter of the body portion and tapering down to a smaller third diameter compatible with the insertion in the central bore 42 of the sleeve 40. Adjacent to the taper portion 20d and at the distal end of the shaft 20 is a tip portion 20f having a third cross sectional diameter and to which the cross member 20g is attached. The interface between the neck portion 20b and the body portion 20c is an abrupt step change in the shaft diameter giving rise to a circumferential shoulder 20h about the shaft.

To prevent the narrow end of the helical spring 90 from sliding over the shoulder 20h of the body portion of the shaft when the spring is in compression, a washer 92 is placed on the shaft against the shoulder 20h such that the narrow end of the spring does not slip over the shoulder.

A typical method for affixing a cross member 20g to the shaft 20 is to machine a hole through the tip portion of the shaft where the cross member is desired and then press-fitting a cylindrical pin 20g into the hole such that the pin will protrude outwardly from the shaft on either side in a substantially perpendicular relationship to the axis of the shaft.

In order to achieve a fine vernier adjustment on the compression of the first member 50 against either the second member 60 or gasket 100 and spacer 70 mounted on the surface of front surface 62 of the second member 60, it is desirable to select the threading pitch of the proximal end 20a to be slightly different from the threading of the sleeve 40 in the threaded portion 114 of the hole 110 such that a differential thread relationship is employed. This type of differential relationship allows for wide flexiability and for the very precise and highly controlled degree of compression between the two members 50 and 60 or between member 50 and spacers 70. This can be of significant importance where, for example, the gasket 100 shown in FIG. 3 is an RFI type of compressible gasket which must be compressed a specified amount to insure the proper conductive continuity between first and second members without proper compressing which could cause ineffective sealing performance.

Second Embodiment

In FIG. 7, there is shown a second embodiment of the present invention. Once again, the handle orientation arrangement is identical to that which is shown in FIGS. 1a, 1b, and 1c. Several noticeable differences between this embodiment and the first embodiment are the absence of the thrust washer 80, the coil spring 90, the washer 92, the spacers 70 and gasket 100. The designs of the handle 10 and sleeve 40 are essentially identical to that of the previous embodiment as shown in FIGS. 1 through 4. The means for pivotally attaching the shaft 120 to the handle 10 is also identical to the knuckle pin type means which has been described with reference to FIGS. 1 through 4. The shaft 120 itself is a straight rod which has a threaded portion 120a at the proximal or handle end. At the opposite (distal) end of the shaft, there is a cylindrical pin 120g which is press-fit into a hole transverse hole through the shaft. Set screw 48 is used to adjustably fix the position of the sleeve 40 in the threaded hole 110. In this embodiment, the members 50 and 60 can be brought together such that the back surface 58 of member 50 is brought into direct contact with the front surface 62 of the member 60 at interface 130. This configuration is not applicable to those situations where an above surface gasket is used which gasket must be compressed to a controlled dimension such as in the prior embodiment. Also because there is no means for retaining the handle 10 in frictional contact with the front surface 56 of the first member 50 when the handle is in a unlocked and relaxed position corresponding to FIG. 1a, the handle must be held in that position to overcome gravity acting on the handle during insertion of shaft 120 into the hole 110 and sleeve 40 in order that pin 120g is aligned to the slots 42a, 42b in the sleeve and the shaft can be seated at an engaging depth. In the unlocked and relaxed position of the handle 10, the handle is not only free to be removed from the sleeve 40 but may also be free to be removed from the first member 50 provided pin 120g can pass through mounting hole 152, since no means for retaining the shaft with handle attached is embodied in the design.

Third Embodiment

In certain applications, the spacer 70 of FIG. 4 may not be required and yet a means for flexibly retaining shaft 20 with handle 10 attached in the mounting hole 110 of the first member 50 to maintain the handle cam surface 12 in frictional contact with the front surface 56 of the first member may be required such that the shaft is not freely removable from the mounting hole 52 and the handle is maintained in any desired gravity overcoming rotational orientation by means of the action of the compressed spring 90 as shown in FIG. 4. A configuration meeting such requirements is shown in the embodiment of FIG. 8. The second member 60 has a counterbore 68 concentric with the mounting hole 110 on the front surface 62 of the second member such that the washer 92 and spring 90 do not interfere with the bringing together of members 50 and 60 in intimate contact at the interface 130. These are the only differences between this embodiment and the first embodiment of FIGS. 1 through 6. The remainder of the elements of this apparatus are identical to those shown there.

Fourth Embodiment

In the three previous embodiments, the second member 60 is shown as a relatively thick structural member such that the mounting hole 110 is sufficiently deep to allow for the insertion of a sleeve 40 entirely within internal threads in the mounting hole itself. In certain applications such a thick second member 60 may not be available. Therefore, an alternative means for providing a holder for the sleeve 40 is required. In FIG. 9, there is shown such a configuration where the sleeve 40 is housed in a holder means 150 having a threaded central hole 144 for receiving and adjustably holding in position the sleeve 40 receptacle means. The holder means 150 is fixedly mounted to the back surface 166 of the second member 160 such that central hole 144 in the holder is coaxially aligned to the mounting hole 110 of the second member. Attachment of the holder means 150 to the second member 160 is by swaging the collar 154*a* which is joined to the main body 154 of the holder means 150. The swaged portion of the collar 154*a* is shown at 156. Because in configurations of this type, the shaft 128 need not be as long as in the previous three configurations, the need for a shaped shaft is an unnecessary complexity. Therefore, alternative means for alignment other than by a body alignment in the mounting hole of the second member are utilized. One possible alternative to this arrangement not shown in the figure is the use of a collar placed on the distal side of the washer 92 by threading the proximal end of the shaft 128 to a depth wherein a collar which is internally threaded and has outside diameters to fit within the mounting hole 110 can be threaded onto the shaft from the proximal end and threaded down to the required position and locked in position there by a set screw. This is not shown in the figure. However, it is a possible means for providing centering of the shaft in the mounting hole 110. The spring and washer retainer can be held in position by a pin 94 which is placed diametrically through the shaft as shown. The engaging (distal) end and the handle (proximal) end of this shaft 128 and associated hardware are functionally identical to those previously described.

Fifth Embodiment

The counterpart of the previous four embodiments is to provide a cross member which is not attached to the shaft but is in effect fixedly attached to the sleeve. Such a configuration is shown in FIGS. 10 and 11. In FIG. 10, there is shown a sleeve 240 which has a pin 242 diametrically mounted across the central bore 244 in the sleeve 240. To engage diametric cross member 242, shaft 220 is a hollow cylindrical rod which has diametrically opposed longitudinal slots 224 proceeding towards midshaft from the distal end. At the engaging depth, the slots 224 transform from longitudinal slots into circumferential slots (not visible) of a minor part of a revolution. At the end of this circumferential slot there is a slight detent towards the distal end of the shaft to more easily locate and secure a captive interlock position of the shaft with the cross pin 242. Because the shaft is a straight shaft without shoulders, some means must be provided, if so desired, to retain the plain washer 92 from sliding down towards the distal end of the shaft when the spring 90 is brought under compression. This is achieved by the use of a pin 94 which is placed at a location along the shaft 220 analogous to the circumferential shoulder 20*h* of the shaped shaft of the first preferred configuration of FIG. 2. The cylindrical rod 220 is threaded at the proximal end, i.e., the end to which the handle 10 is pivotally attached, to accommodate the means for pivotally attaching the handle to the rod as previously described with reference to FIGS. 1 through 4. The other features of FIG. 10 are basically the same as those discussed with reference to the prior embodiments. FIG. 11 is a cross section showing the alignment of the cross member 242 mounted to the sleeve 240 and its relationship to the diametrically opposing longitudinal slots 224 of the hollow cylindrical rod 220. The longitudinal slots 224 are shown in a position corresponding to the handle being in a locked and taut position. Assuming the handle were in a locked and relaxed condition, by rotating the handle slightly the slots 224 would be aligned to the fixed cross member 242 thereby allowing withdrawal of the cylindrical shaft from the sleeve 240 and allowing the members 50 and 60 to be separated.

Sixth Embodiment

A somewhat different approach to the concept of the FIG. 10 embodiment is shown in FIG. 12, 13, and 14. In this configuration, the shaft 320 is comprised of a cylindrical rod having threads extending from the distal (leading) end to approximately mid shaft. The proximal (handle) end also has threads to accommodate the handle arrangement described previously. Captive interlock is achieved by employing an externally slotted collar 350 mounted on the distal end of the shaft 320 with keyplate 340. The collar 350, having two external keyway slots 322, is affixed to the distal end of the shaft 320, in this case by internal threads matching the threads on the distal end of the shaft and held in place by a set screw (not shown). Collar 350 is prevented from withdrawal from the mounting hole in the second member by means of a keyplate mounted to the back surface 166 of the second member 160. The keyplate has a keyhole 346 with tabs 342 extending radially inward which allow passage of collar 350 through the keyhole when the tabs are aligned to the keyslots 322 on the collar by orientation of the handle such that insertion of the collar through the keyplate hole is achieved. After insertion of collar 350 through the keyhole 346 on condition slots 322 are properly aligned to tabs 342, a rotation of the handle about the shaft axis misaligns the tabs and the slot preventing withdrawal of the collared shaft and thereby anchoring the distal end of the shaft. FIG. 13, in expanded view, shows a cross section of collar 350 emplaced on the distal end of the shaft 320 showing keyway slots 322 and the keyway tabs 342 and their positional relationships when the handle 10 is in a locked and taut condition. Note that the keyway tabs 342 and the slots 322 are misaligned, therefore, withdrawal of the shaft from the mounting hole 110 is prevented thereby allowing the members 50 and 160 to be brought into a compressed gapped relationship by virtue of the cam action of the handle 10 as it is rotated about its cam axis and along its cam surface 12. FIG. 14 is an expanded cross sectional view showing the details of the keyplate 340 and the keyhole 346 with tabs 342.

Seventh Embodiment

This embodiment relates to a method for positively latching two members together involving use of a latching apparatus identical or similar to any of the six previous embodiments of the present invention. The method hereinbelow will be described with reference to the latching apparatus of the second embodiment corresponding to FIG. 7. First, the latching apparatus comprising two parts, the shaft 120 with handle 10 pivotally attached to the shaft and the sleeve 40 must be provided. Next, the shaft 120 must be inserted into the mounting hole 152. Next, the sleeve 40 must be installed in the mounting hole 140, adjusted for depth by trial and error, and then fixed in position using set screw 48. This is followed by holding the handle 10 in a horizontal position, such as is shown in FIG. 1*a* and inserting shaft 120 into hole 110 and receptacle sleeve 40 until pin 120*g* clears the back end of the sleeve. The shaft 120 then rotated to cause pin 120*g* and the shaft itself to be captively interlocked by the sleeve 40. A concluding pivoting of the handle 10 about the knuckle pin a half-turn causes the cam surface 12 to slideably rotate and push increasingly harder against the surface 56 thereby latchably compressing and holding together first member 50 to second member 60.

Although the invention has been described and illustrated in detail it is clearly understood that the same is by way of illustration only and is not to be taken by way of limitation, the spirit and scope of this invention being limited only by the terms of the appended claims.

I claim:

1. A latching combination for adjustably pressing and holding together two members in an abutting or controlled gap relationship, comprising:

a first and second member, wherein each of said members has a front and back surface, and has a mounting hole therein, and wherein said mounting holes are coaxially aligned when said members are in an abutting or controlled gap relationship;

a handle having a longitudinal axis with a near end and an opposite end in the shape of a cam surface, said cam surface having a cam axis of rotation perpendicular to the longitudinal axis of said handle;

a shaft supported in said mounting hole disposed in said first member, wherein said shaft has a proximal and distal end projecting beyond said front and back surfaces of said first member respectively;

a means for pivotally and adjustably attaching said opposite end of said handle to said proximal end of said shaft so that the position of said pivotal attachment of said handle can be adjusted along said shaft;

a means for rotatably interlocking said distal end of said shaft with said second member; and a receptacle means for adjustably affixing to said second member and coaxial with said mounting hole therein and for conditionally receiving said means for rotatably interlocking to an adjustable seating depth.

2. The latching apparatus according to claim 1, wherein said means for rotatably interlocking comprises a cross member affixed to said shaft in the proximity of said distal end of said shaft protruding outwardly of and substantially perpendicular to the axis of said shaft.

3. The latching apparatus according to claim 2, wherein said receptacle means comprises a sleeve adjustably retained in said mounting hole of said second member, said sleeve having a central bore with diametrically opposing key slots of dimensions allowing the free passage of said cross member which is affixed to said shaft to an engaging depth on condition said cross member is aligned to said bore key slot with handle in a correspondingly unlocked and relaxed condition, and upon subsequent rotation of said shaft a predetermined amount and direction about said shaft's longitudinal axis captively interlocks said cross member with said receptacle means in a correspondingly locked and relaxed condition to thereby enable said first and second members to be compressed and held together by the lever action of said handle cam surface slideably rotating and pushing increasingly harder against said front surface surrounding said mounting hole of said first member as said handle is pivoted substantially a half turn about said cam axis to thereby pull on the shaft anchored at its distal end by said cross member captively interlocked with said receptacle means.

4. The latching apparatus according to claim 3:

wherein said shaft comprises a cylindrical rod having a threaded portion at said proximal end and a transverse hole in the proximity of said distal end of said shaft; and wherein said cross member comprises a cylindrical press fit pin inserted in said transverse hole to protrude outwardly of said shaft.

5. The latching apparatus according to claim 4:

wherein said opposite end of said handle comprises a bifurcation into a pair of facing planar parts substantially parallel to each other, said pair having cam-shaped edges and holes coaxially aligned to each other to define said cam axis;

wherein said means for pivotally and adjustably attaching said opposite end of said handle to said proximal end of said shaft comprises a set screw and a cylindrical knuckle pin of diameter fitted to rotate smoothly within said coaxially aligned holes in said facing planar parts of said handle, said knuckle pin having a threaded hole perpendicular to said pin axis for receiving said threaded proximal end of said shaft thereby enabling said handle to be attached to said shaft straddled by said planar parts and having a threaded axial bore for receiving said set screw to hold said shaft in adjustably fixed position; and wherein said shaft has a planar surface unified with said threaded proximal end for receiving a point of said set screw.

6. The latching apparatus according to claim 5, wherein the pitch of the threaded counterparts corresponding to said receptacle means and mounting hole in said second member relative to the pitch of the threads corresponding to said proximal end of said shaft and said knuckle pin are selected to provide a differentially related adjustment of finer resolution than achievable with a single thread pitch.

7. The latching apparatus according to claim 3:

further comprising means for flexibly retaining said shaft with said handle attached in said mounting hole of said first member to maintain said handle cam surface in frictional contact with said front surface of said first member; and wherein said mounting hole in said second member has a counterbore adjacent said second member front surface to freely accommodate said means for flexibly retaining said shaft in said mounting hole without interference to said members being compressed and held together.

8. The latching apparatus according to claim 7, wherein said shaft comprises:

a threaded portion at said proximal end;

a neck portion adjacent said threaded portion having a first cross-sectional diameter;

a body portion adjacent said neck portion having a second cross-sectional diameter larger than said first cross-sectional diameter to form a circumferential shoulder about said shaft at the boundary between said neck and body portions;

a tapered portion adjacent said body portion starting from said second cross-sectional diameter and tapering down to a smaller third cross-sectional diameter; and a rounded tip portion at said distal end having a third cross-sectional diameter and to which said cross member is attached.

9. The latching apparatus according to claim 8, wherein said means for flexibly retaining said shaft comprises:

a plain washer for placing on said neck portion of said shaft abutting said circumferential shoulder; and a frustum-shaped helical coil spring having a wide end and a narrow end for mounting on said neck portion of said shaft under compression between said inner surface of said first member and said plain washer abutting said circumferential shoulder of said shaft, said wide end abutting said inner surface and said narrow end abutting said plain washer, said plain washer preventing said narrow end from slipping beyond said shoulder when said spring is compressed.

10. The latching apparatus according to claim 9:

wherein said opposite end of said handle comprises a bifurcation into a pair of facing planar parts substantially parallel to each other, said pair having cam-shaped edges and holes coaxially aligned to each other to define said cam axis; and wherein said means pivotally attaching said opposite end of said handle to said proximal end of said shaft comprises a set screw and a cylindrical knuckle pin of diameter fitted to rotate smoothly within said coaxially aligned holes in said facing planar parts of said handle, said knuckle pin having a threaded hole perpendicular to said pin axis for receiving said threaded proximal end of said shaft thereby enabling said handle to be attached to said shaft straddled by said planar parts and having a threaded axial bore for receiving said set screw to hold said shaft in adjustably fixed position.

11. The latching apparatus according to claim 1, further comprising:

means for flexibly retaining said shaft with said handle attached in said mounting hole of said first member to maintain said handle cam surface in frictional contact with said front surface of said first member; and means for providing a controlled gap between said members to freely accommodate said means for flexibly retaining said shaft in said mounting hole without interference to said members being compressed and held together in gapped relationship.

12. The latching apparatus according to claim 11 wherein said means for providing a controlled gap comprises a spacer mounted on said front surface of said second member.

13. The latching apparatus according to claim 12:

wherein said hole in said second member has a concentric threaded counterbore adjacent said second member back surface;

wherein said receptacle means comprises an externally threaded cylindrical sleeve for adjustable screw insertion in said threaded counterbore, said sleeve having a central coaxial hole to receive said distal end of said shaft and a cross member fixedly mounted transversely and diametrically across said central coaxial hole; and wherein said shaft is a hollow cylindrical rod of outer diameter to fit through said central coaxial hole of said sleeve having a pair of diametrically opposing longitudinal slots at said distal end of dimensions to receive said cross member to seating depth, said longitudinal slots being terminated in partially circumferential slots, said circumferential slots having a detent towards said distal end.

14. The latching apparatus according to claim 12:

wherein said shaft comprises a cylindrical rod having threads extending from said distal end to approximately mid-shaft;

further comprising a set screw and a cylindrical collar having at least one external keyway slot and internal threads matching said threads extending from said distal end of said rod to mount said collar on said rod and means for holding said collar in position on said rod; and wherein said receptacle means comprises a key plate having a keyhole therein for fixedly mounting on said second member having at least one keyway tab extending radially inward from the edge of said keyhole, which keyhole is coaxially aligned to said mounting hole in said second member, said keyhole and tab of dimensions serving to conditionally allow the free penetration to engaging depth of said collar adjustably mounted towards said distal end of said shaft upon condition said key slot is rotationally aligned to said keyplate tab whereupon a predetermined direction and rotation of said shaft and collar misaligns said slot and tab preventing the withdrawal of said collared shaft thereby anchoring said distal end.

15. The latching apparatus according to claim 1:

wherein said opposite end of said handle comprises a bifurcation into a pair of facing planar parts substantially parallel to each other, said pair having cam-shaped edges and holes coaxially aligned to each other to define said cam axis;

wherein said shaft has threads on said proximal end; and wherein said means pivotally attaching said opposite end of said handle to said proximal end of said shaft comprises a set screw and a cylindrical knuckle pin of diameter fitted to rotate smoothly within said coaxially aligned holes in said facing planar parts of said handle, said knuckle pin having a threaded hole perpendicular to said pin axis for receiving said threaded proximal end of said shaft thereby enabling said handle to be attached to said shaft straddled by said planar parts and, having a threaded axial bore for receiving said set screw to hold said shaft in adjustably fixed position.

16. The latching apparatus according to claim 15:

wherein said mounting hole in said first member has a counterbore adjacent said front surface; and further comprising a thrust washer having a washer portion adjoining a neck portion, said washer portion interposed between said handle cam surface and said front surface of said first member beyond said counterbore and said neck portion fitting freely within said counterbore, said washer accepting and dispersively transferring to said front surface beyond said counterbore the force of said handle cam surface slideably rotating and pushing against said washer.

17. The latching apparatus according to claim 16, further comprising:

means for flexibly retaining said shaft with said handle attached in said mounting hole of said first member to maintain said handle cam surface in frictional contact with said front surface of said first member; and means for providing a controlled gap between said members to freely accommodate said means for flexibly retaining said shaft in said mounting hole without interference to said members being compressed and held together in gapped relationship.

18. The latching apparatus according to claim 17:

wherein said means for providing a controlled gap comprises a spacer mounted on said front surface of said second member;

wherein said means for rotatably interlocking as a male counterpart comprises a cross member affixed to said shaft in the proximity of said distal end of said shaft protruding outwardly of and substantially perpendicular to the axis of said shaft; and wherein said receptacle means comprises a sleeve adjustably retained in said mounting hole of said second member as threaded male and female counterparts, said sleeve having a central bore with diametrically opposing key slots of dimensions to freely pass through said cross member affixed to said shaft to engaging depth on condition said cross member is aligned to said bore key slot with handle in correspondingly unlocked and relaxed condition, and thereupon rotating said shaft a predetermined amount and direction about the shaft longitudinal axis to captively interlock said cross member with said receptacle means in correspondingly locked and relaxed condition, thereby enabling said first and second members to be compressed and held together by cam action of said handle cam surface slidably rotating and pushing increasingly harder against said front surface of said first member surrounding said mounting hole of said first member as said handle is pivoted substantially a half-turn about said cam axis thereby pulling on the shaft anchored at its distal end by said cross member captively interlocked with said receiving means.

19. The latchkng apparatus according to claim 18, wherein said shaft comprises:

a threaded portion at said proximal end;

a neck portion adjacent said threaded portion having a first cross-sectional diameter;

a body portion adjacent said neck portion having a second cross-sectional diameter larger than said first cross-sectional diameter to form a circumferential shoulder about said shaft;

a tapered portion adjacent said body portion starting from said second cross-sectional diameter and tapering down to a smaller third cross-sectional diameter; and a tip portion at said distal end having a third cross-sectional diameter and to which said cross member is attached.

20. The latching apparatus according to claim 19, wherein said means for flexibly retaining said shaft comprises:

a plain washer for placing on said neck portion of said shaft abutting said circumferential shoulder; and a frustum-shaped helical coil spring having a wide end and a narrow and for mounting on said neck portion of said shaft under compression between said back surface of said first member and plain washer abutting said circumferential shoulder of said shaft, said wide end abutting said back surface and said narrow end abutting said plain washer.

21. The latching apparatus according to claim 20:

wherein said tip portion has a tranverse hole; and wherein said cross member comprises a cylindrical press-fit pin inserted in said transverse hole of said tip portion to protrude outwardly of said shaft.

22. The latching apparatus according to claim 18:

wherein said shaft comprises a cylindrical rod having a threaded portion at said proximal end, a first transverse hole in the proximity of said threaded portion, and a second transverse hole in the proximity of said distal end of said shaft;

further comprising first and second cylindrical press-fit pins inserted in said first and second transverse holes respectively, to protrude outwardly of said shaft;

further comprising holder means having a central hole therein for receiving and adjustably holding in position said receptacle means, said holder means fixedly mounted to said second member wherein said central hole is coaxially aligned to said mounting hole in said second member, said receptacle means and said holder means being male and female threaded counterparts, respectively;

further comprising a set screw; and wherein said receptacle means and holder means are adapted to receive said set screw to hold said receptacle means in position.

23. The latching apparatus according to claim 22, wherein said means for flexibly retaining said shaft comprises:

a plain washer for placing on said shaft from said proximal end and abutting said first cylindrical pin; and a frustum-shaped helical coil spring having a wide end and a narrow end for mounting on said shaft under compression between said inner surface of said first member and said plain washer, said wide end abutting said inner surface and said narrow end abutting said plain washer.

24. The latching apparatus according to claim 18:

wherein said mounting hole in said second member has a concentric threaded counterbore adjacent said second member back surface;

wherein said receptacle means comprises an externally threaded cylindrical sleeve for adjustable screw insertion in said threaded counterbore, said sleeve having a central coaxial hole to receive said distal end of said shaft and a cross member fixedly mounted transversely and diametrically across said central coaxial hole; and wherein said shaft is a hollow cylindrical rod of outer diameter to fit through said central coaxial hole of said sleeve having a pair of diametrically opposing longitudinal slots at said distal end of dimensions to receive said cross member to seating depth, said longitudinal slots being terminated in partially circumferential slots, said circumferential slots having a detent towards said distal end.

25. The latching apparatus according to claim 17:

wherein said means for providing a controlled gap comprises a spacer mounted on said front surface of said second member;

wherein said shaft comprises a cylindrical rod having threads extending from said distal end to approximately mid-shaft;

further comprising first and second cylindrical collars, said first collar having at least one external keyway slot and each collar having internal threads matched to said threads on said rod for adjustably mounting said collars thereon, said first collar positioned near said distal end and said second collar positioned near mid-shaft serving to center said shaft in said second member mounting hole, and means for individually holding said collars mounted on said shaft in desired fixed positions; and wherein said receptacle means comprises a key plate having a keyhole therein for fixedly mounting on said second member having at least one keyway tab extending radially inward from the edge of said key hole, which keyhole is coaxially aligned to said mounting hole in said second member, said keyhole and tab of dimensions serving to conditionally allow the free penetration to engaging depth of said collar adjustably mounted towards said distal end of said shaft and fixed thereat by said means for individually holding said collars upon condition said key slot is rotationally aligned to said keyplate tab whereupon a predetermined direction and rotation of said shaft and collar misaligns said slot and tab preventing the withdrawal of said collared shaft thereby anchoring said distal end.

26. A releasable positive latching combination for adjustably pressing and holding together two members in an abutting or controlled gap relationship, comprising:

a first and second member, each having a front surface and a back surface and each having a mounting hole coaxially aligned with respect to each other when said members are held together, said first member having a counterbore adjacent said first member front surface;

a fixed separator interposed between said first member back surface and said second member front surface to create a gap between said members;

a handle having a near end and a bifurcated opposite end having a pair of facing planar parts substantially parallel to each other, said pair having edges in the shape of cam surfaces having holes therein coaxially aligned to each other to define a cam axis of rotation perpendicular to the longitudinal axis of said handle;

a thrust washer having a washer portion adjoining a neck portion, said washer portion interposed between said handle cam surface and said front surface beyond said counterbore and said neck portion fitting freely within said counterbore, whereby said washer accepts and dispersely transfers to said front surface beyond said counterbore the force of said handle cam surface slidably rotating and pushing against said washer;

a shaft supported in said first member mounting hole having proximal and distal ends, said proximal and distal ends projecting beyond said front and back surfaces of said first member, respectively;

means pivotally attaching said opposite end of said handle to said proximal end of said shaft;

a cross member affixed to said shaft in the proximity of said distal end of said shaft protruding outwardly of and substantially perpendicular to the axis of said shaft;

means for flexibly retaining said shaft with said handle attached in said mounting hole of said first member to maintain said handle cam surface in frictional contact with said front surface of said first member; and receptacle means adjustably retained in said mounting hole of said second member having a central bore with diametrically opposing key slots of dimensions to freely pass said cross member affixed to said shaft for conditionally receiving said shaft cross member to engaging depth on condition said cross member is aligned to said bore key slot corresponding to an unlocked and relaxed condition, and thereupon, with the aid of said handle oriented at a right angle to said shaft, said shaft being rotated a predetermined amount and direction about the shaft longitudinal axis to engage said cross member with said receiving means in interlocking relation corresponding to an interlocked and relaxed condition, to further enable said first and second members to be compressed and held together in a correspondingly locked and compressed condition by cam-action of said handle cam surface slidably rotating and pushing against said front surface of said first member surrounding said mounting hole of said first member by pivoting said handle substantially a half-turn about said cam axis thereby pulling on the shaft anchored at its distal end by said cross member interlocked with said receiving means.

27. The latching apparatus according to claim 26:

wherein said shaft has threads unified with a planar surface for receiving the point of a set screw on said proximal end and a transverse hole in the proximity of said distal end of said shaft;

wherein said means pivotally attaching said opposite end of said handle to said proximal end of said shaft comprises a set screw and a cylindrical knuckle pin of diameter fitted to rotate smoothly within said coaxially aligned holes in said facing planar parts of said handle, said knuckle pin having a threaded hole perpendicular to said pin axis for receiving said threaded proximal end of said shaft thereby enabling said handle to be attached to said shaft straddled by said planar parts, said knuckle pin having a threaded axial bore for receiving said set screw to hold said shaft in adjustably fixed position; and wherein said cross member comprises a cylindrical press-fit pin for inserting in said transverse hole to protrude outwardly from said shaft.

28. The latching apparatus according to claim 27, wherein said shaft comprises:

a threaded portion at said proximal end;

a neck portion adjacent said threaded portion having a first cross-sectional diameter;

a body portion adjacent said neck portion having a second cross-sectional diameter larger than said first cross-sectional diameter to form a circumferential shoulder about said shaft;

a tapered portion adjacent said body portion starting from said second cross-sectional diameter and tapering down to a smaller third cross-sectional diameter; and a tip portion at said distal end having a third cross-sectional diameter and a transverse hole and to which said cross member is attached; and wherein said cross member comprises a cylindrical press-fit pin for inserting in said transverse hole to protrude outwardly of said shaft.

29. The latching apparatus according to claim 28, wherein said means for flexibly retaining said shaft comprises:

a plain washer for placing on said neck portion of said shaft abutting said circumferential shoulder; and a frustum-shaped helical coil spring having a wide end and a narrow end for mounting on said neck portion of said shaft under compression between said inner surface of said first member and said circumferential shoulder of said shaft, said wide end abutting said inner surface and said narrow end abutting said shoulder.

* * * * *